US009279403B2

(12) United States Patent
Pasedach et al.

(10) Patent No.: US 9,279,403 B2
(45) Date of Patent: Mar. 8, 2016

(54) CLOSURE BOLT FOR AN INJECTOR

(71) Applicant: Robert Bosch GmbH, Stuttgart (DE)

(72) Inventors: Sven Pasedach, Hallein (AT); Christian Graspeuntner, Hallein (AT)

(73) Assignee: Robert Bosch GmbH, Stuttgart (DE)

( * ) Notice: Subject to any disclaimer, the term of this patent is extended or adjusted under 35 U.S.C. 154(b) by 287 days.

(21) Appl. No.: 13/890,043

(22) Filed: May 8, 2013

(65) Prior Publication Data

US 2013/0298873 A1 Nov. 14, 2013

(30) Foreign Application Priority Data

May 8, 2012 (AT) ..... A 548/2012

(51) Int. Cl.

| | |
|---|---|
| ***F02M 55/00*** | (2006.01) |
| ***F02M 63/00*** | (2006.01) |
| ***F02M 55/02*** | (2006.01) |
| ***F02M 63/02*** | (2006.01) |
| ***F02M 61/16*** | (2006.01) |

(52) U.S. Cl.

CPC ..... *F02M 63/0003* (2013.01); *F02M 55/005* (2013.01); *F02M 55/025* (2013.01); *F02M 61/165* (2013.01); *F02M 63/0054* (2013.01); *F02M 63/0078* (2013.01); *F02M 63/0205* (2013.01); *F02M 2200/18* (2013.01)

(58) Field of Classification Search

CPC ..... F02M 63/0225; F02M 55/025; F02M 69/044; F02M 63/0003; F02M 55/004; F02M 55/005; F02M 59/462; F02M 59/464; F02M 59/485

See application file for complete search history.

(56) References Cited

U.S. PATENT DOCUMENTS

| | | | | |
|---|---|---|---|---|
| 6,116,273 | A | 9/2000 | Tarr et al. | |
| 6,928,984 | B1 * | 8/2005 | Shamine | F02M 55/005 123/456 |
| 7,216,631 | B2 * | 5/2007 | Nishiwaki | F02M 55/005 123/467 |
| 8,596,247 | B2 * | 12/2013 | Tower | F02M 55/005 123/468 |
| 8,726,884 | B2 * | 5/2014 | Hackett | F02M 43/04 123/456 |
| 2003/0217726 | A1 | 11/2003 | Kennedy et al. | |
| 2011/0315117 | A1 | 12/2011 | Gerstner et al. | |
| 2013/0092131 | A1 * | 4/2013 | Graspeuntner | F02M 55/005 123/456 |

FOREIGN PATENT DOCUMENTS

| | | |
|---|---|---|
| DE | 198 60 476 A1 | 7/2000 |
| DE | 10 2005 010 738 A1 | 9/2006 |

(Continued)

*Primary Examiner* — Lindsay Low
*Assistant Examiner* — Robert Werner
(74) *Attorney, Agent, or Firm* — Maginot, Moore & Beck LLP

(57) ABSTRACT

A closure bolt for an injector of a modular common-rail fuel injection system includes at least one high-pressure port for high-pressure fuel and a bolt-like portion which is configured to be inserted into an opening of the injector and which has a first, preferably conical, sealing surface for closing the opening in a high-pressure-tight manner. The bolt-like portion has a high-pressure bore which is hydraulically connected to the high-pressure port and which issues into the injector. The closure bolt further includes a throughflow limiter configured to limit the flow rate of fuel delivered into the injector. The bolt-like portion has an insert in which the throughflow limiter is formed and which bears the first sealing surface.

16 Claims, 2 Drawing Sheets

(56) References Cited

FOREIGN PATENT DOCUMENTS

| | | | |
|---|---|---|---|
| EP | 0 357 247 | A1 | 3/1990 |
| EP | 0 780 569 | A1 | 6/1997 |
| EP | 1 653 076 | A1 | 5/2006 |
| WO | 03/076794 | A1 | 9/2003 |
| WO | 2009/033304 | A1 | 3/2009 |
| WO | 2011/160148 | A1 | 12/2011 |
| WO | WO 2011160148 | A1 * | 12/2011 |

* cited by examiner

CLOSURE BOLT FOR AN INJECTOR

This application claims priority under 35 U.S.C. §119 to patent application no. AT 548/2012, filed on May 8, 2012 in Austria, the disclosure of which is incorporated herein by reference in its entirety.

BACKGROUND

The disclosure relates to a closure bolt for an injector of a modular common-rail fuel injection system.

Modular common-rail systems are characterized in that a part of the accumulator volume present in the system is provided in the injector itself. Modular common-rail systems are used in particularly large engines in which the individual injectors are, under some circumstances, mounted at considerable distances from one another. The mere use of a common rail for all of the injectors is not expedient in such engines because an extreme drop in injection pressure would occur during the injection owing to the long lines, such that the injection rate would drop significantly in the case of a relatively long injection duration. In such engines, therefore, provision is made for a high-pressure accumulator to be arranged in the interior of each injector. Such a design is referred to as a modular construction because each individual injector has its own high-pressure accumulator and can thus be inserted as an independent module. Here, a high-pressure accumulator is not to be understood to mean a conventional line, but is rather a pressure-tight vessel with an inlet line and an outlet line, the diameter of which vessel is considerably greater than that of the high-pressure lines in order that a certain injection flow rate can be discharged from the high-pressure accumulator without an immediate pressure drop occurring.

High-pressure fuel is supplied to injectors of modular common-rail systems from a high-pressure pump, wherein the supply is usually realized via an opening of the injector on the top side of the high-pressure accumulator (so-called "top feed"). The connection of the high-pressure line, which conducts the high-pressure fuel, to the injector is realized here by means of a closure bolt, the latter being provided with a high-pressure port and having a portion which can be inserted into the opening of the injector and which has a preferably conical sealing surface for closing the opening in a high-pressure tight manner. The volume of the integrated high-pressure accumulator is sealed off in this way. The closure bolt generally also has the function of conducting through the fuel for the adjacent injectors, for which purpose a second high-pressure port is provided.

A throughflow limiter is integrated into the closure bolt, which throughflow limiter separates the injector from the high-pressure fuel inflow in the event of an excessively high throughflow rate.

For manufacturing reasons, the closure bolt in the embodiment according to the prior art has a high-pressure bore which is continuous in an axial direction, into which high-pressure bore the high-pressure port issues radially and via which high-pressure bore the high-pressure fuel is conducted into the high-pressure accumulator. The axial high-pressure bore is sealed off to the outside by means of a closure screw.

A disadvantage of the described design of the closure bolt is that its inner contour is, owing to the geometry, subjected over the entire length to the full pressure of the high-pressure fuel, such that with regard to the geometric design and the roughness depths, high quality is required which is however difficult to achieve during production. Problems are posed in particular by the geometries, which are difficult to produce, for the throughflow limiter. This has the result that a durable design is no longer possible for system pressures of over 1600 bar.

It is therefore an aim of the present disclosure to avoid the above-described disadvantages. The disclosure is furthermore based on the object of providing a design which is simpler to produce and by means of which it is possible for the closing flow rate of the throughflow limiter to be adapted in a simple manner to the respective requirements.

SUMMARY

To achieve said object, the closure bolt of the type specified in the introduction, comprising at least one high-pressure port for high-pressure fuel, a bolt-like portion which can be inserted into an opening of the injector and which has a first, preferably conical sealing surface for closing the opening in a high-pressure-tight manner, wherein the bolt-like portion has a high-pressure bore which is hydraulically connected to the high-pressure port and which issues into the injector, and a throughflow limiter for limiting the flow rate of fuel delivered into the injector, is according to the disclosure designed substantially in that the bolt-like portion has an insert in which the throughflow limiter is formed and which bears the first sealing surface. The bolt-like portion of the closure bolt is thus formed in at least two parts, wherein the insert faces towards the high-pressure accumulator and, by means of the first sealing surface, ensures the sealing of the high-pressure accumulator. By virtue of the fact that the throughflow limiter is now arranged in said insert, the geometries, which are difficult to produce, of the throughflow limiter are limited to the insert, such that the main body of the closure bolt is significantly easier to produce. In particular, it is possible for those geometries of the main body which are acted on with high pressure to be formed with the suitable radii and surfaces without difficulties in terms of manufacture. Furthermore, the two-part design has the effect that the high-pressure bore of the closure bolt need no longer extend through the entire closure bolt, such that it is possible to dispense with the use of a closure screw, whereby the risk of manipulation by unauthorized persons is reduced. A further advantage is that, while maintaining the same main body, the insert can be easily exchanged, such that a simple adaptation of the closing flow rate of the throughflow limiter can be achieved through the provision of a multiplicity of insert with throughflow limiters of different design.

The insert need not have dedicated connecting means in order to be connected to the main body. In fact, one preferred embodiment provides that the screw connection of the main body to the injector body simultaneously provides the required holding force for the insert. For this purpose, the design is preferably such that the insert has a shoulder with a second, preferably conical sealing surface which interacts with a counterpart surface of the bolt-like portion. The screwing-in process of the closure bolt then imparts the required sealing force to both sealing surfaces, specifically to the first sealing surface generated between the injector body and the insert, and to the second sealing surface generated between the insert and the main body of the closure bolt or of the bolt-like portion.

The first and/or the second sealing surface are/is preferably of conical form.

It is advantageous for an axial portion, which in particular adjoins the shoulder, of the insert to be received in a receiving bore of the bolt-like portion. It is particularly preferable for the throughflow limiter to be at least partially arranged in said axial portion, whereby a high degree of durability can be attained. This is the case in particular if, corresponding to a preferred refinement, the axial portion of the insert is received in the receiving bore in such a way that it can be acted on with the pressure of the high-pressure fuel from the outside and from the inside. In this way, a pressure-balanced region is created which is subjected to pressure fluctuations of significantly lower magnitude. In particular, the pressure shocks acting on the throughflow limiter are minimized. In the pressure-balanced region, the geometries, which are difficult to produce, of the throughflow limiter can be readily realized without impairing durability. To achieve a pressure-balanced region, that portion of the insert which is received in the receiving bore is formed, at least in its front region, with an outer diameter which is reduced slightly in relation to the rear region facing toward the high-pressure accumulator. Furthermore, the insert is designed such that a gap remains between its end surface and the base of the receiving bore, in order that the insert can be acted on by the high-pressure fuel from the outside in the pressure-balanced region.

Furthermore, a preferred refinement provides that the receiving bore has, at the transition to the high-pressure bore, an annular abutment surface for the closing element, in particular the ball of the throughflow limiter.

In order, during the injection of fuel into the combustion chamber of the internal combustion engine, to permit a replenishment flow of fuel into the high-pressure accumulator, and in order to prevent mutual interference of the injection pressure or of the injection flow rate of the individual injectors, it is preferably provided that the high-pressure bore issues into the injector via a throttle formed in the insert. The arrangement of the throttle in the insert has the advantage that an adaptation of the throttle cross section to the respective requirements is possible in a simple manner by exchanging the insert, without it being necessary for the entire closure bolt to be replaced for this purpose.

It is preferable for an edge-type filter to be arranged in the insert, which filter retains coarse particles from the fuel.

BRIEF DESCRIPTION OF THE DRAWINGS

The disclosure will be explained in more detail below on the basis of exemplary embodiments schematically illustrated in the drawing. In the drawing.

DETAILED DESCRIPTION

Figure 1:
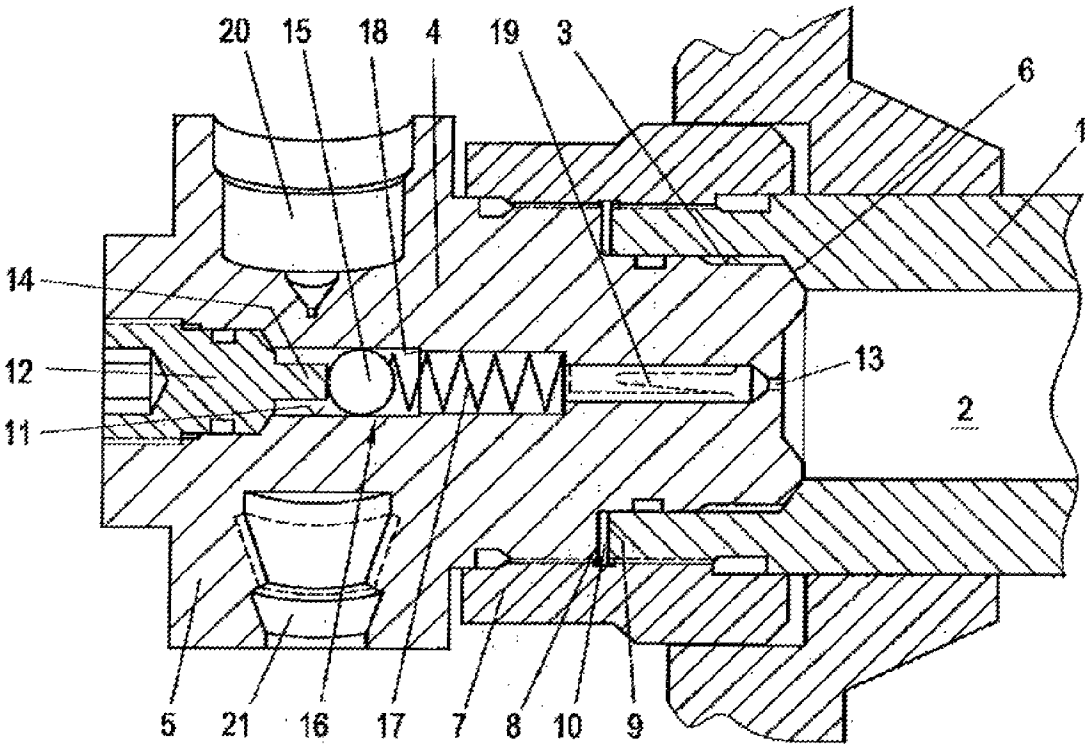
Fig. 1 Prior Art
FIG. 1 shows a design of the closure bolt according to the prior art.

FIG. 1 illustrates an end portion of an injector body 1 in which a high-pressure accumulator 2 is integrated. The part accommodating the high-pressure accumulator 2 is sometimes also referred to as a holding body. The injector or holding body 1 has an opening 3 which leads to the high-pressure accumulator 2 and into which a bolt-like portion 4 of a closure bolt 5 is inserted. The bolt-like portion 4 has, on the end side facing toward the high-pressure accumulator 2, a conical sealing surface 6 which interacts with a corresponding counterpart surface on the edge of the opening 3. The required holding force is imparted by means of a clamping nut 7 which, by means of its internal thread, interacts with external threads, which adjoin one another axially, of the injector body 1 and the closure bolt 5. Between the shoulder 8 of the closure bolt 5 and the annular end surface 9 of the injector body 1, there is provided a gap 10 in order to avoid a double fit.

Furthermore, a high-pressure bore 11 is provided which extends axially through the closure bolt 5 and which is closed off on one side by means of a closure screw 12 and which is connected on the other side to the high-pressure accumulator 2 via a throttle 13. The closure screw 12 has a central projection 14 which supports a ball 15 of the throughflow limiter 16. The ball 15 is loaded in the direction of the projection 14 by means of a helical spring 17. The valve seat of the throughflow limiter 16 is denoted by 18. The function of the throughflow limiter 16 is as follows: In the case of common rail systems, under unfavorable circumstances, leakages may occur, be it in the line system or as a result of defective injection valves. Injection valves with jamming nozzle needles, which lead to continuous injections into the combustion chamber, can cause considerable damage. Such damage may lead to the vehicle catching fire or to the engine being destroyed. Throughflow limiters with a closing function serve to avoid these risks; such throughflow limiters, in the event of an exceedance of a maximum extraction flow rate from the high-pressure accumulator, close the inlet to the respective injector and thus decouple the injection-pump-side high pressure from the injection valve side.

In the design according to FIG. 1, the ball 15 in the bore 11 is pressed against a stop (projection 14), and, as a result of the flow generated during the injection, moves in the direction of the sealing seat 18 owing to the pressure difference in the flow around the ball. In the event of an exceedance of a maximum injection flow rate, the ball 15 passes into the seat 18 and prevents a further flow into the injector, whereby a continuous injection is prevented.

In the high-pressure bore 11 there is also arranged an edge-type filter 19. Into the high-pressure bore 11 there issues a radial line which is equipped with a high-pressure port 20. To the high-pressure port 20 there is connected a line (not illustrated in any more detail) via which high-pressure fuel is supplied from a high-pressure pump (not illustrated). The closure bolt 5 has a further high-pressure port 21 by which a connection to a subsequent injector can be produced.

In the design according to FIG. 1, during operation, the high-pressure bore 11 is charged with the pressure of the high-pressure fuel, which, in the case of system pressures of over 1600 bar, leads to inadmissible dynamic loading in the region of the radii and similar geometries required for the formation of the throughflow limiter.

Figure 2:
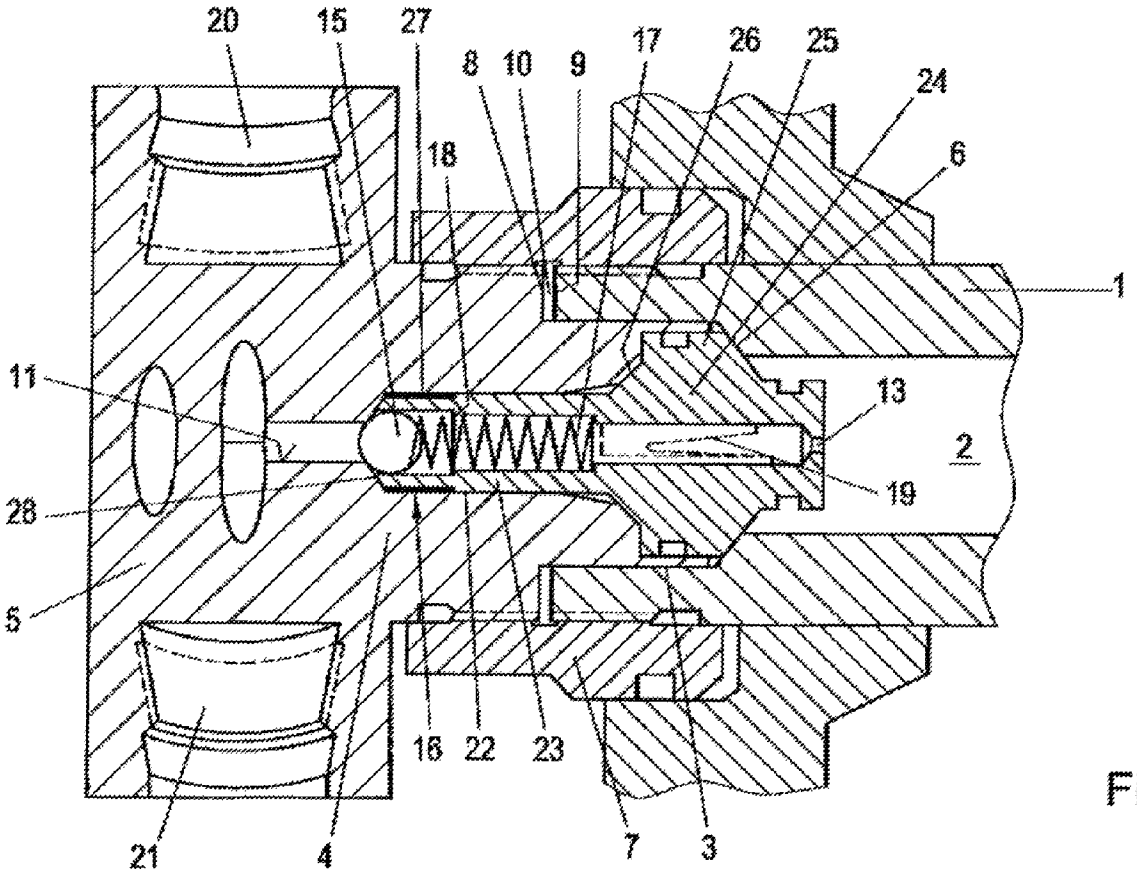
FIG. 2 shows a design according to the present disclosure.

In the design according to the disclosure according to FIG. 2, the same reference numerals as in FIG. 1 are used for identical parts. The bolt-like portion 4 of the closure bolt 5 has a receiving bore 22 in which an axial portion 23 of an insert 24 is received. The insert 24 accommodates, in the high-pressure bore 11, the throughflow limiter 16, the edge-type filter 19 and the throttle 13. The insert 24 has a shoulder 25 on which is formed a conical sealing surface 26 which interacts with a conical counterpart surface of the bolt-like portion 4. This has the effect that the screw connection of the closure bolt 5 by means of the clamping nut 7 simultaneously generates a sealing force on the sealing surface 6 and on the sealing surface 26.

The end surface of the axial portion 23 ends at a distance in front of the annular abutment surface 28 provided at the transition of the receiving bore 22 to the high-pressure bore 11. Furthermore, the axial portion 23 which is received in the receiving bore 22 is formed, in its front region 27, with a reduced outer diameter, such that, in the annular gap hereby formed between the outer circumference of the front region 27 of the axial portion 23 and the receiving bore 22, the pressure of the high-pressure fuel can act on the throughflow limiter 16 from the outside. This leads to a pressure-balanced region of the throughflow limiter 16, such that the fluctuating loading is reduced.

What is claimed is:

1. A closure bolt for an injector of a modular common-rail fuel injection system, comprising:

at least one high-pressure port formed in the closure bolt for high-pressure fuel;

a bolt-like portion configured to be inserted into an opening of the injector, the bolt-like portion having (i) a first sealing surface configured to close the opening in a high-pressure-tight manner and (ii) a high-pressure bore which is hydraulically connected to the high-pressure port and which issues into the injector; and a throughflow limiter configured to limit a flow rate of fuel delivered into the injector, wherein the bolt-like portion has an insert in which the throughflow limiter is formed and which bears the first sealing surface, wherein an axial portion of the insert is received in a receiving bore of the bolt-like portion, the axial portion of the insert defining a passage, and wherein the axial portion of the insert is configured to be acted on with pressure of the high-pressure fuel from outside the axial portion of the insert and from inside the passage defined by the axial portion of the insert.

2. The closure bolt according to claim 1, wherein the insert has a shoulder with a second sealing surface which interacts with a counterpart surface of the bolt-like portion.

3. The closure bolt according to claim 1, wherein the throughflow limiter is arranged at least partially in the axial portion of the insert.

4. The closure bolt according to claim 1, wherein the receiving bore, at a transition to the high-pressure bore, has an annular abutment surface for a closing element of the throughflow limiter.

5. The closure bolt according to claim 1, wherein the high-pressure bore issues into the injector via a throttle formed in the insert.

6. The closure bolt according to claim 1, wherein an edge-type filter is arranged in the insert.

7. An injector of a modular common-rail fuel injection system, comprising:

an injector body;

a high-pressure accumulator integrated in the injector body; and a closure bolt configured to close off the high-pressure accumulator, the closure bolt including at least one high-pressure port formed in the closure bolt for high-pressure fuel;

a bolt-like portion configured to be inserted into an opening to the high-pressure accumulator, the bolt-like portion having (i) a first sealing surface configured to close the opening in a high-pressure-tight manner and (ii) a high-pressure bore which is hydraulically connected to the high-pressure port and which issues into the high-pressure accumulator; and a throughflow limiter configured to limit a flow rate of fuel delivered into the high-pressure accumulator, wherein the bolt-like portion has an insert in which the throughflow limiter is formed and which bears the first sealing surface, wherein an axial portion of the insert is received in a receiving bore of the bolt-like portion, the axial portion of the insert defining a passage, and wherein the axial portion of the insert is configured to be acted on with pressure of the high-pressure fuel from outside the axial portion of the insert and from inside the passage defined by the axial portion of the insert.

8. The injector according to claim 7, wherein the closure bolt and the injector body are connected to one another by a clamping nut.

9. The closure bolt according to claim 1, wherein the first sealing surface is conical.

10. The closure bolt according to claim 2, wherein the second sealing surface is conical.

11. The closure bolt according to claim 1, wherein the insert has a shoulder with a second sealing surface which interacts with a counterpart surface of the bolt-like portion and wherein the axial portion adjoins the shoulder.

12. The closure bolt according to claim 4, wherein the closing element of the throughflow limiter is a ball.

13. The closure bolt according to claim 1, wherein:

the axial portion of the insert includes a valve seat located in the passage, a closing element of the throughflow limiter is configured to prevent fluid flow through the passage when the closing element is seated against the valve seat, and the closing element is configured to enable fluid flow through the passage when the closing element is spaced apart from the valve seat.

14. The closure bolt according to claim 1, wherein:

the closure bolt and the injector body are connected to one another by a clamping nut, and the first sealing surface is configured to fixedly close the opening in the high-pressure-tight manner when the closure bolt and the injector body are connected to one another.

15. The closure bolt according to claim 7, wherein:

the axial portion of the insert includes a valve seat located in the passage, a closing element of the throughflow limiter is configured to prevent fluid flow through the passage when the closing element is seated against the valve seat, and the closing element is configured to enable fluid flow through the passage when the closing element is spaced apart from the valve seat.

16. The closure bolt according to claim 8, wherein the first sealing surface is configured to fixedly close the opening in the high-pressure-tight manner when the closure bolt and the injector body are connected to one another.

* * * * *